United States Patent [19]

Jenne et al.

[11] Patent Number: 4,821,813

[45] Date of Patent: Apr. 18, 1989

[54] PERCUSSION DRILLING APPARATUS

[75] Inventors: Gustav Jenne, Essen-Kettwig, Fed. Rep. of Germany; Dietmar Jenne, Strengelbach, Switzerland

[73] Assignee: Terre AG fur Tiefbautechnik, Strengelbach, Switzerland

[21] Appl. No.: 36,410

[22] Filed: Mar. 24, 1987

[30] Foreign Application Priority Data

May 7, 1986 [CH] Switzerland ..... 1863/86

[51] Int. Cl.[4] ..... B23B 45/16

[52] U.S. Cl. ..... 173/135; 173/91; 91/416

[58] Field of Search ..... 173/17, 116, 135, 91; 91/416, 417

[56] References Cited

U.S. PATENT DOCUMENTS

| | | | |
|---|---|---|---|
| 3,970,153 | 7/1976 | Gien et al. | 173/17 |
| 4,221,157 | 9/1980 | Schmidt | 173/135 |
| 4,530,407 | 7/1985 | Rean | 173/17 |

FOREIGN PATENT DOCUMENTS

| | | |
|---|---|---|
| 2105229 | 2/1971 | Fed. Rep. of Germany . |
| 2634066 | 7/1976 | Fed. Rep. of Germany . |

*Primary Examiner*—Frank T. Yost
*Assistant Examiner*—Willmon Fridie, Jr.

[57] ABSTRACT

A percussion drilling apparatus has a control unit in which a displacement reversing unit is arranged axially adjacent to a piston control unit, with the result that the control edges for the apparatus advance and apparatus return can be arranged in separate control sleeves. This control unit makes it possible to achieve better apparatus characteristics and higher overall efficiency of the apparatus.

12 Claims, 3 Drawing Sheets

PERCUSSION DRILLING APPARATUS

BACKGROUND OF THE INVENTION

The invention relates to a percussion drilling apparatus having a control unit.

In a known percussion drilling apparatus according to German Pat. No. 2,634,066, a control unit is provided with a control pipe which is axially non-displaceable in an end screw connection of the housing of the apparatus and possesses the compressed air feed, and on whose free end sits a control sleeve which is arranged non-rotatably with respect to the housing. The control pipe can be rotated in this and in the end screw connection. In the region of its free end, it has control orifices for reversing the forward and return flow of the apparatus, or vice versa, these orifices being capable of being brought into coincidence with corresponding orifices in the control sleeve. The control sleeve is provided with control orifices which are essentially adjacent to one another and interact with corresponding orifices in a percussion piston, which slides back and forth on this control sleeve and is displaceable in the housing of the percussion drilling apparatus, for controlling the piston either during its advance cycle or during its return cycle. Moreover, the orifices for the advance cycle and return cycle are arranged alternately one after the other, for example a return control orifice follows an advance control orifice, etc.

This alternate arrangement of advance control orifices and return control orifices has a very substantial disadvantage since this arrangement means that these control orifices and hence the entire displacement process can no longer be freely optimized. This is particularly important for ensuring that such percussion drilling apparatuses run reliably in a backward direction even when used in a vertical position. Furthermore, it is not possible to arrange seals to exclude stray air, which in some cases has a substantial adverse effect on the reversing processes and the displacement sequences. Moreover, this secondary air also results in substantial energy losses. The radial structure of the control unit also imposes restrictions in terms of the dimensions and hence the material cross-sections. This is particularly so in the case of small apparatuses. In connection with the flow behavior, which particularly in this case cannot be optimized, pronounced turbulence can occur in the region of the control orifices, which on the one hand has an adverse effect on the control processes and on the other hand has been found to lead to high vibration loads and therefore frequently to fractures in the control components of the apparatus.

A percussion drilling apparatus of a similar type, whose control differs from that described above only in the removal of the compressed air and in the method of fixing in the advance and return positions, is described in German Pat. No. 2,105,229. It therefore also has the above-mentioned disadvantages.

SUMMARY OF THE PRESENT INVENTION

It is therefore the object of the invention to provide a percussion drilling apparatus which has a control unit which makes it possible to avoid the above-mentioned disadvantages and to achieve higher efficiency with regard to the consumption of the flowing medium. Moreover, by improving the control unit, it is intended to achieve better, smoother running of the percussion drilling apparatus and hence greater accuracy.

This object is achieved, in the case of a percussion drilling apparatus according to the present invention.

Further features and details of the invention are evident from the description of an embodiment, with reference to the drawing, wherein:

DESCRIPTION OF THE PREFERRED EMBODIMENTS

Figure 6:
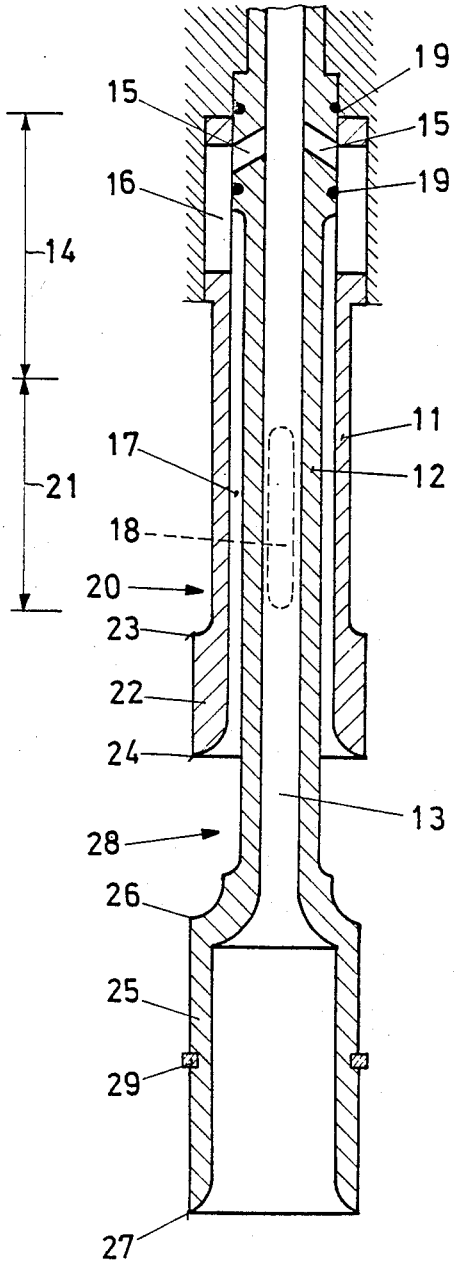
FIG. 6 shows another embodiment of the external rotary slide element shown in FIGS. 2–5.

The percussion drilling apparatus has a housing 1 which is provided with a pile shoe and in which a percussion piston 2 moves back and forth between the pile shoe and a housing closure 3, which is preferably in the form of a screw part having exhaust ports 4. The housing closure 3 carries a coupling unit 5 for feeding a flowing medium, in particular compressed air, into the interior of the housing 1. In addition, the closure contains a displacement reversing unit 6 which controls only the advance and return displacement of the percussion drilling apparatus. A piston control unit 7 is provided axially adjacent to this displacement reversing unit 6, and is connected to the latter, the piston control unit controlling the percussion displacement of the percussion piston 2. It projects into a hole 8 of the percussion piston 2 and interacts with piston transfer ports 9 which are arranged in the piston and end in longitudinal channels 10 of the percussion piston 2, which in turn end at the front face of the percussion piston. The displacement reversing unit 6 essentially consists of an external rotary slide element 11, which is connected to the housing closure 3, and an internal rotary slide element 12 which is rotatably but undisplaceably mounted in this element. The rotary slide element 12 has a centrally arranged principal channel 13 for the flowing medium, which is connected to the coupling unit 5. Adjacent to this is the return region 14 of the displacement reversing unit 6, and in this region the internal rotary slide element 12 has at least one first transfer port 15, which ends in the principal channel 13 for the flowing medium. This first transfer port 15 is preferably inclined with respect to the axis of the principal channel 13 for the flowing medium. Packings 19, which are preferably O-rings, are provided on both sides of this first transfer port 15, on the outside of the internal rotary slide element 12. In order to obtain two switching points of the displacement reversing unit 6, at least one second transfer port 16 is let into the adjacent part of the external rotary slide element 11 (FIG. 6) or into the housing closure 3 (FIGS. 2–5), corresponding to the first transfer port 15, the transfer port 16 leading to at least one third transfer port 17 which is located in the internal rotary slide element 12 and is positioned in the same way as the first transfer port 15. This fixes the open position in the return region of the displacement reversing unit 6. This third transfer port 17 is preferably a longitudinal channel and ends in an advance region of the displacement reversing unit 6, which has in this region at least one, fourth transfer port 18 in the external rotary slide element 11, which port 18 is offset in the periphery in such a way that, in the above predetermined open position in the return region 14, it does not communicate with the third transfer port 17 but is overlapped by the internal rotary slide element 12. This fourth transfer port 18 leads to an exhaust space 20 of the housing 1. This section of the displacement reversing unit 6 which contains the fourth transfer port 18 thus forms the advance region 21. The piston control unit 7 is connected to this.

This piston control unit 7 has an external return control sleeve 22 which is preferably connected to the external rotary slide element 11 or is formed as a single piece with this element. The return control sleeve has a rear return control edge 23, which is adjacent to the displacement reversing unit, and a front return control edge 24 which is axially displaced from the said edge 23. The external diameter of return control sleeve 22 corresponds to the internal diameter of the hole 8 in the percussion piston, which has to slide over the said sleeve 22. The lateral surface of the return control sleeve 22 is preferably slightly conical at its leading end. This external return control sleeve contains an internal spacing element which is preferably connected to the internal rotary slide element 12 or is formed as a single piece with it and carries an advance control sleeve 25 whose external diameter likewise corresponds to the internal diameter of the hole 8 in the percussion piston 2, which slides over it. The sleeve 25 has a rear advance control edge 26 which is located at a distance from the front return control edge 24 and together with this defines an annular region 28, a front advance control edge 27 being present a distance away from this in the direction of the axis. The control sleeves are arranged in succession in the axial direction and separately from one another. Furthermore, a sealing element 29 is inserted in the advance control sleeve 25. This avoids losses of the flowing medium through leakage. To connect the annular region 28 between the two control sleeves 22 and 25, a channel which corresponds to the third transfer port of the displacement reversing unit 6 and ends in this is provided in the internal control pipe. In the preferred embodiment in which the internal control pipe and the internal rotary slide element 12 form a single piece, this channel is a single, continuous channel. Furthermore, the central principal flowing medium channel 13 of the internal rotary slide element 12 is continued in the internal spacing element in the form of a channel which preferably gradually widens and has advantageous flow characteristics and which is used to feed the flowing medium during the advance of the percussion piston 2. To avoid turbulence, the surfaces adjacent to the control edges of the two control sleeves are also preferably in the form of surfaces which ensure gradual transitions and have advantageous flow characteristics. The distance between the control edges on each of the control sleeves and the distance between the control sleeves 22, 25 can be optimized and/or selected, on the one hand for the displacement sequence and the specific apparatus parameters and on the other hand according to the intended use and the conditions of use, for example the composition of the earth, etc, and can be fixed independently of one another.

This possibility of optimization means not only substantially lower consumption of flowing medium but also a higher overall efficiency of the apparatus and better running characteristics, which in turn result in the work being carried out more exactly. In particular, this makes it possible substantially to increase the accuracy of aim. Furthermore, this also makes it possible to optimize control for vertical use of the percussion drilling apparatus too and hence ensures work of higher quality and less secondary work also in the case of vertical use. Particularly as a result of the separation of the assemblies for displacement reversal and piston control, i.e. moving the control for the return (return region) to the region of the housing closure 3, it is possible virtually completely to avoid effects due to transverse-flowing medium, and loss of performance due to these effects. By dispensing with nesting of the two groups of control edges, that is the group of advance control edges and the group of return control edges, and arranging them in succession on adjacent control sleeves, at intervals in the axial direction, the effect of transverse-flowing medium, in the region of the control edges, on the advance is eliminated, this effect being very troublesome and reducing performance.

The advance control edges can therefore be fixed completely independently of the return control edges and can also be changed subsequently, independently of one another. In selecting the control edges, it is not necessary to make compromises by nesting the particular control edges.

In the region of the housing closure 3, a locking device 30 is provided which is effective between this closure and the internal rotary slide element 12. This locking device is a pin locking device whose spring-loaded locking pin 31 can also be adjusted by means of a tensioning screw 32 which controls the spring tension. Thus, the displacement reversing unit 6 can be fixed only for the advance or only for the return of the percussion drilling apparatus.

Figure 1:
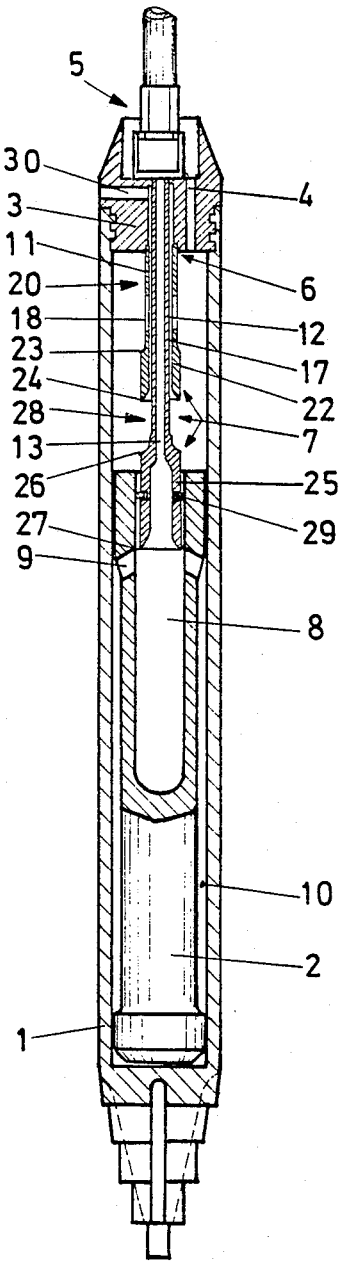
FIG. 1 shows a longitudinal section through a percussion drilling apparatus.
Figure 2:
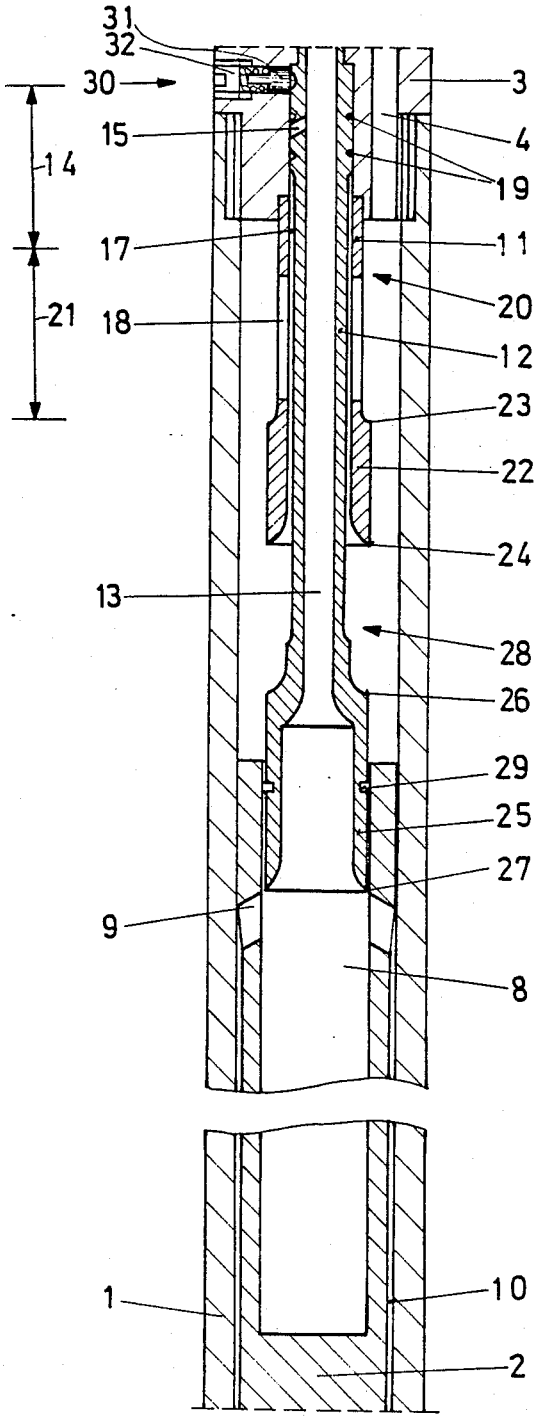
FIG. 2 shows the region of the control unit of the percussion drilling apparatus in cross-section, in the advance position.
Figure 3:
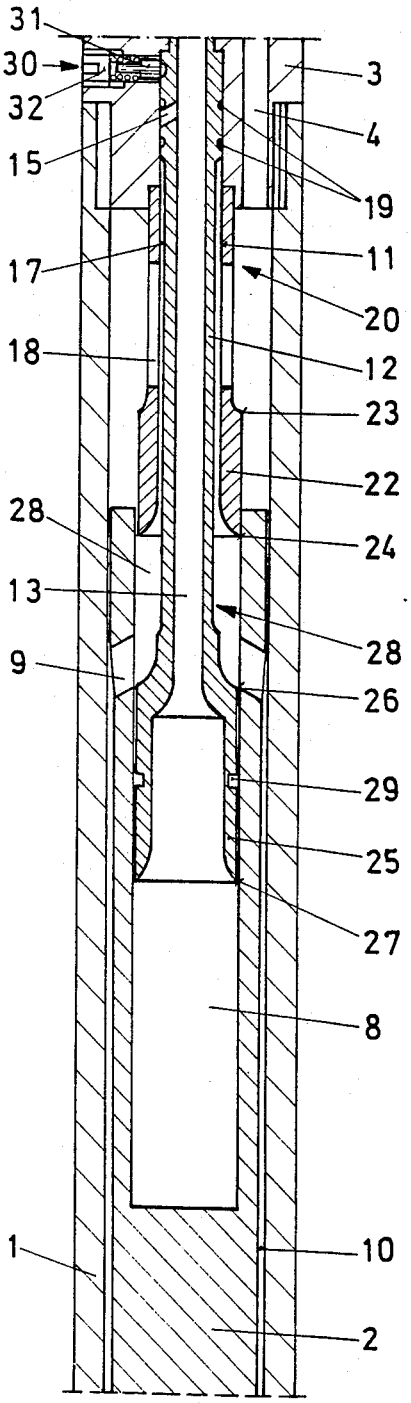
FIG. 3 shows the region of the control unit of the percussion drilling apparatus in cross-section, in the advance position, but in a different displacement phase or control phase of the percussion piston.
Figure 4:
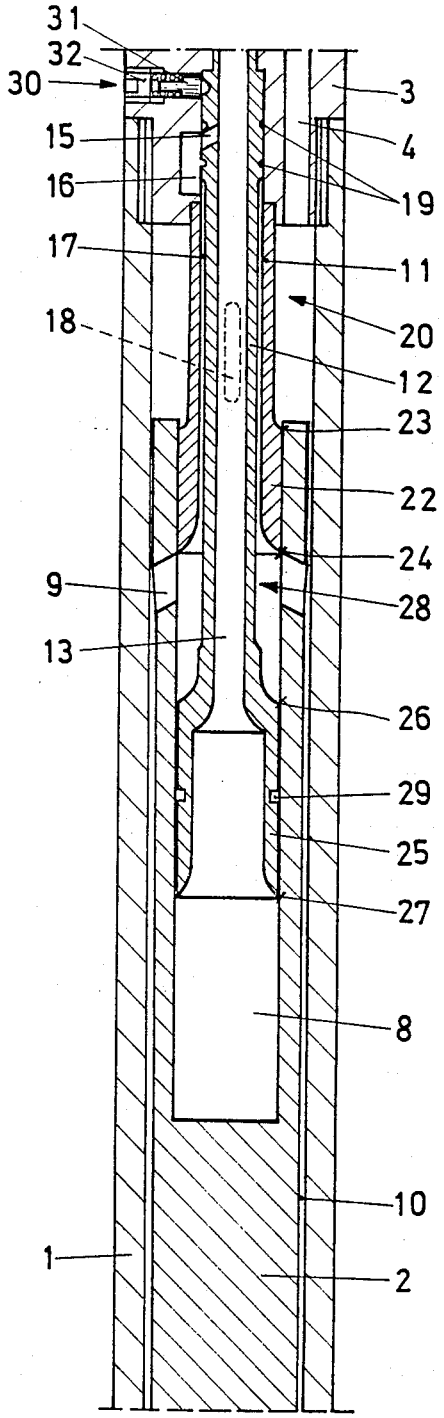
FIG. 4 shows the region of the control unit of the percussion drilling apparatus in cross-section, in the return position.
Figure 5:
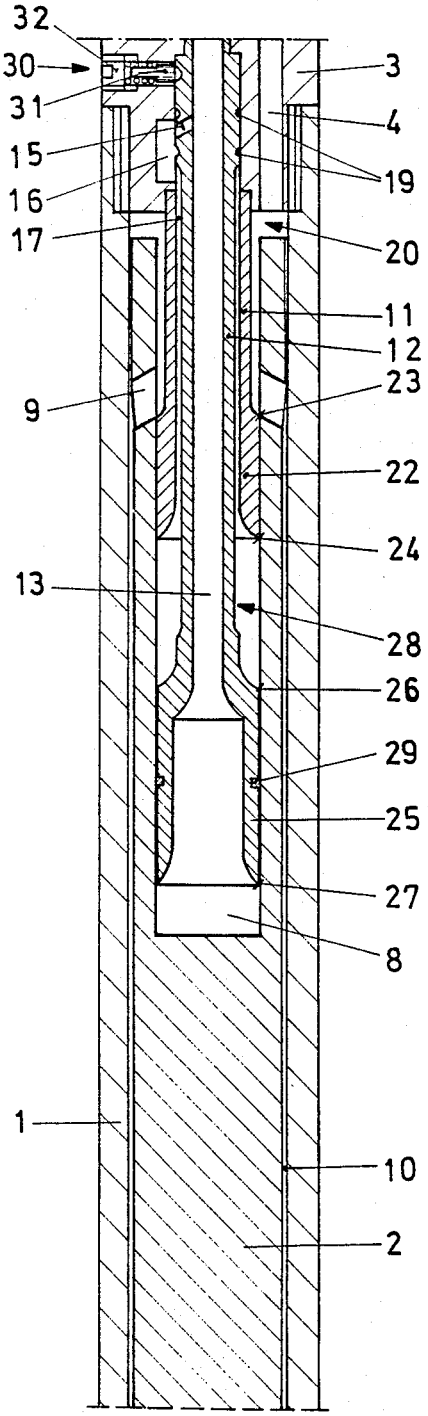
FIG. 5 shows the same region of the control unit in the return position, but in a different control phase.

If the displacement reversing unit 6 is in the "advance" position, i.e. the percussion drilling apparatus rams itself into the earth, the rotary slide control in the return region 14 is in the closed position, and the flowing medium passes through the principal flowing medium channel 13 and behind the percussion piston 2 and drives the latter against the shoe of the percussion drilling apparatus, until the piston transfer ports 9 pass over the front advance control edge and the flowing medium passes through them along the outside of the piston to its front face. Before being braked by this countercurrent, it strikes the housing and drives it deeper into the earth (FIG. 2). Once sufficient counter-pressure has built up in front of the piston, it is displaced backward toward the control unit and passes over the rear advance control edge 26. As a result, the flowing medium present at the head of the percussion piston 2 flows into the annular space 28 between the two control sleeves 22 and 25 and passes into the third transfer port 17. When the displacement reversing unit 6 is in the closed position in the return region, it is in the open position in the advance region 21, i.e. the fourth transfer port 18 communicates with the third transfer port 17, with the result that the flowing medium passes into the exhaust space 20 and through the exhaust ports 4 in housing closure 3 and into the atmosphere or into a collecting line (FIG. 3). The flowing medium present in the inner hole 8 now softly brakes the percussion piston; the percussion piston 2 thus does not come into contact with the rear housing closure 3. The advance cycle now begins again.

During the return cycle (FIG. 4, 5), the rotary slide element of the displacement reversing unit 6 is in its open position in the return region 14, and flowing medium passes from the principal flowing medium channel 13 via the first transfer port 15 and the second transfer port 16 into the third transfer port 17 and then into the annular space 28 between the two control sleeves 22 and 25. If the piston transfer ports 9 are in front of the front return control edge, the flowing medium under pressure passes through the piston transfer ports 9 to the front face of the percussion piston 2 and brakes it softly in the front. Thus, the percussion piston 2 does not come into contact with the front of the housing. The percussion piston 2 is then accelerated backward until its piston transfer ports 9 pass behind the rear return control edge 23. The flowing medium present in front of the percussion piston 2 then escapes through the exhaust space 20 and the exhaust ports 4 into the atmosphere or into a collecting line. Depending on the position of the control edges, which can be optimized, the percussion piston 2 strikes the housing closure at various speeds and moves the percussion drilling apparatus backward out of the drill hole. This is important, for example, when an obstacle which cannot be overcome by the percussion drilling apparatus, for example a large rock, makes advance work impossible, or when the percussion drilling apparatus is used for vertical drilling. The flowing medium under pressure in the hole 8 in percussion piston 2 brings the percussion piston 2 once again into its starting position which corresponds to the return movement and in which the piston transfer ports 9 are located in front of the front return control edge 24, and flowing medium is again fed from the annular space 28 to the front of the percussion piston 2.

In addition to the advantages already stated above, there is the further advantage that this percussion drilling apparatus can be reversed by applying flowing medium under pressure and that "oscillating control", i.e. reversal of advance and return in quick succession owing to pressure fluctuations, which may occur at any time, is avoided.

We claim:

1. A percussion drilling apparatus comprising:

a housing and a piston axially movable within said housing by a medium flowing under pressure;

a displacement reversing unit for controlling reversal by said flowing medium between advance and return displacement of the drilling apparatus, said unit being of a rotary slide type with control slide elements rotatably arranged one inside another, said piston and said displacement reversing unit including interacting lateral control ports therein for passage therethrough of said flowing medium, a piston controlling unit, coaxially connected with said displacement reversing unit and axially displaced therefrom, said piston controlling unit including two control sleeves each of said sleeves having a front controlling edge, each of said sleeves controlling one of the two directions of displacement of said apparatus, said sleeves being connected coaxially in succession in the axial direction and separately from each other, such that said controlling edges of one sleeve are positioned at a distance from said controlling edges of said other sleeve.

2. A percussion drilling apparatus as claimed in claim 1, wherein said displacement reversing unit (6) has an external rotary slide element (11) connected to a housing closure (3), and an internal rotary slide element (12) which is rotatably mounted therein, said internal element forming a main flowing medium channel (13) connectable to a feed line for the flowing medium and wherein at least one first transfer port (15) leading from the main flowing medium channel (13) to said external rotary slide element (11) is provided in a return region (14) of said displacement reversing unit (6) located on said housing closure side, and at least one second transfer port (16) is provided in said external rotary slide element (11), which interacts with the first transfer port (15) in a return control position and communicates with at least one-third transfer port (17) in the internal rotary slide element (12) and at least one-fourth transfer port (18), which in said return control position is displaced with respect to the third transfer port (17) and communicates with an exhaust space (20) in housing (1), is provided in the external rotary slide element (11), in an advance region (21) which is located on that side of the return region (14) which is nearest to the housing tip.

3. A percussion drilling apparatus as claimed in claim 2, wherein the internal rotary slide element (12) has packings (19) on its outer lateral surface, on both sides of the first transfer port (15).

4. A percussion drilling apparatus as claimed in claim 2, wherein the displacement reversing unit (6) is provided with a locking device (30) for engaging or locking in each of the control positions.

5. A percussion drilling apparatus as claimed in claim 4, wherein the locking device (30) has a spring-loaded locking pin (31) which can also be set by means of a spring tensioning screw (32).

6. A percussion drilling apparatus as claimed in claim 2, wherein said control sleeves include a return and an advance control sleeve, said return control sleeve (22) is being connected to the external rotary slide element (11) and said advance control sleeve (22) is being connected to the internal rotary slide element (12), and an annular space (28) formed therebetween connects to the third transfer port (17), and said main flowing medium channel (13) passes through said advance control sleeve (25).

7. A percussion drilling apparatus as claimed in claim 6, wherein at least one of said control sleeves (22,25) includes a packing (29) which interacts with the percussion piston (2).

8. A percussion drilling apparatus as claimed in claim 6, wherein the lateral surfaces of the control sleeves (22, 25) form a substantially common cylindrical surface, along which the inner cylinder of the percussion piston (2) is displaceable.

9. A percussion drilling apparatus as claimed in claim 8, wherein the front part of the lateral surface of the return control sleeve (22) is a conical surface.

10. A percussion drilling apparatus as claimed in claims 2 or 6, wherein at least one of the transfer ports (15, 15, 17, 18) and/or said annular space (28) have rounded shapes for obtaining advantageous reversal times.

11. A percussion drilling apparatus as claimed in claim 2, wherein the first transfer port (15) is inclined with respect to the axis of the rotary slide element.

12. A percussion drilling apparatus as claimed in claim 2, wherein the first transfer port is perpendicular to the axis of the rotary slide element.

* * * * *

UNITED STATES PATENT AND TRADEMARK OFFICE

CERTIFICATE OF CORRECTION

PATENT NO. : 4,821,813

DATED : April 18, 1989

INVENTOR(S) : Gustav Jenne and Dietmar Jenne

It is certified that error appears in the above-identified patent and that said Letters Patent is hereby corrected as shown below:

On the title page, change "[73] Assignee: Terre AG" to --[73] Assignee: Terra AG--.

Signed and Sealed this

Seventh Day of November, 1989

*Attest:*

JEFFREY M. SAMUELS

*Attesting Officer*

*Acting Commissioner of Patents and Trademarks*